US005658014A

United States Patent [19]

Barker et al.

[11] Patent Number: 5,658,014

[45] Date of Patent: Aug. 19, 1997

[54] CLIPBOARD

[75] Inventors: Frederick S. Barker, Grand Rapids, Mich.; Jarrod L. Linton, New York, N.Y.; David K. Peschel, San Francisco, Calif.; Stephen D. Russak, Fort Lee, N.J.; Tucker L. Viemeister, New York, N.Y.

[73] Assignee: Steelcase Inc., Grand Rapids, Mich.

[21] Appl. No.: 401,864

[22] Filed: Mar. 10, 1995

[51] Int. Cl.[6] ..... B42F 1/00

[52] U.S. Cl. ..... 281/45

[58] Field of Search ..... 281/15.1, 28, 42, 281/45, 51; 248/447.1, 441.1, 447.2; 24/67.5, 67.7; 312/184; 211/45, 48

[56] References Cited

U.S. PATENT DOCUMENTS

D. 284,483 7/1986 Yang .
D. 284,776 7/1986 McKinnon, Jr. .
2,862,328 12/1958 Wadsworth ..... 248/447.1 X
5,058,242 10/1991 Liu et al. ..... 281/45 X
5,145,141 9/1992 Hunter ..... 281/45 X

*Primary Examiner*—Willmon Fridie, Jr.
*Attorney, Agent, or Firm*—Price, Heneveld, Cooper, DeWitt & Litton

[57] ABSTRACT

A clipboard which is capable of being suspended on a slat wall for conspicuous display and/or easy access, includes a spring clip disposed on the front side of a writing board and a wall support positioned on the backside of the clipboard for suspending the clipboard on a slat wall or other similar support. The clipboard can also be hung on spaced, parallel rails of suspended-file storage units and includes a pair of tabs, each of which projects laterally outward from opposing side edges of the writing board. Each of the tabs includes hanger edges which engage the upper edges of the spaced, parallel rails.

18 Claims, 2 Drawing Sheets

CLIPBOARD

BACKGROUND OF THE INVENTION

This invention relates to clipboards having a writing board with a spring clip for holding papers and the like, and, more particularly, to such clipboards which can be suspended on a slat wall, from file suspension rails, or both.

It is, of course, well known that clipboards are extremely useful in a variety of business, industrial and institutional applications in which a portable writing board is desired. For certain applications, it can be desirable to retain papers and/or other similar materials on the clipboard and to suspend the clipboard on a vertical surface or wall in order to conspicuously display printed or handwritten information, maintain easy access of the clipboard and any information recorded on paper held by the clipboard, or both.

Known means for suspending a clipboard on a wall or other vertical surface have included magnets, adhesives, and fastener openings for hanging the clipboard on a nail, hook or the like. These known means for suspending a clipboard all have certain functional disadvantages, aesthetic disadvantages, or both. Magnets are obviously limited to metal walls, metal file cabinets or other metal surfaces, which can sometimes be undesirable for aesthetic reasons. Another disadvantage is that magnets having a magnetic field which is strong enough to support a clipboard which can retain a large stack of papers can be somewhat difficult to separate from the metal support surface when the clipboard is not retaining a large stack of papers. Adhesives for supporting a clipboard on a wall or other vertical surface have several very obvious disadvantages, such as limited reusability and either excessive or insufficient tackiness for securing the clipboard and papers to a particular wall or vertical surface without damaging the surface or leaving residue thereon. An opening in the clipboard for receiving a nail, hook or other support member provides a simple and effective means for suspending a clipboard on a wall, but requires installing unsightly and potentially dangerous projecting nails or similar support members onto a wall or other vertical surface on which the clipboard is to be suspended.

McKinnon, Jr., (U.S. Design Pat. No. 284,776) discloses a clipboard having a pair of upper, laterally disposed, rearwardly projecting, slotted bracket members which can apparently be used for supporting the clipboard on a pair of upwardly projecting support rods. This design has substantially the same disadvantages as the previously discussed clipboards adapted to be hung on nails, hooks or the like. Specifically, in order to mount the clipboard disclosed by McKinnon, Jr., to a wall, a pair of support members having upwardly projecting rod portions would need to be mounted to the wall. These wall mounted support members would likely be aesthetically unappealing and could, for example, cause pain and injury to a person who inadvertently backs into them.

There are also occasions when it can be desirable to retain paper on a clipboard and store the clipboard and paper together in a file drawer. For example, written information pertaining to several different active subjects or projects could be separately retained, each on its own individual clipboard, to form a plurality of active files which can be stored together in a file drawer in accordance with a prescribed file organization system. Clipboard based files could be very convenient in a variety of situations where information is frequently hand written into a file at a location remote from a desk top or other suitable writing board. However, commercially available clipboards typically require a very specialized support mechanism.

SUMMARY OF THE INVENTION

The invention in accordance with one aspect thereof provides a clipboard which can be hung or suspended on a slat wall for conspicuous display and easy access. The improved clipboard of the invention is generally more reliable, easier to mount or dismount from a wall, and/or has a more aesthetically pleasing appearance than previous wall mountable clipboards which rely on magnets, adhesives or openings for receiving conventional fasteners, such as nails or the like. The clipboard in accordance with the first aspect of the invention includes a writing board, a spring clip on the front side of the writing board for holding papers and the like on the writing board, and a support on the backside of the writing board for hanging or suspending the clipboard on a slat wall.

In accordance with another aspect of the invention, a clipboard which can be suspended on a pair of spaced, parallel rails, such as are customarily used to suspend conventional hanging file folders, allows convenient filing of papers retained on the clipboard. The clipboard in accordance with this aspect of the invention includes a writing board with a spring clip on the front side thereof and a pair of tabs which extend laterally outwardly and downwardly from the top edge of the clipboard, and which are adapted to engage spaced, parallel rails of a hanging-file storage unit.

Yet another aspect of the present invention is a clipboard which can be either hung on a slat wall or suspended on a pair of spaced, parallel rails to allow either display and easy access of the clipboard and papers held on the clipboard or filing of papers being held on the clipboard, respectively. Accordingly, the invention also encompasses clipboards having a writing board with a spring clip on the front side, a support attached to the backside of the writing board for suspending the clipboard on a slat wall and a pair of tabs which extend laterally outwardly and downwardly from the top edge of the clipboard, for engaging spaced, parallel rails of a hanging-file storage unit.

These and other advantages of the invention will be further understood and appreciated by those skilled in the art by refernce to the following written specification, claims, and appended drawings.

DESCRIPTION OF THE PREFERRED EMBODIMENT

Figure 1:
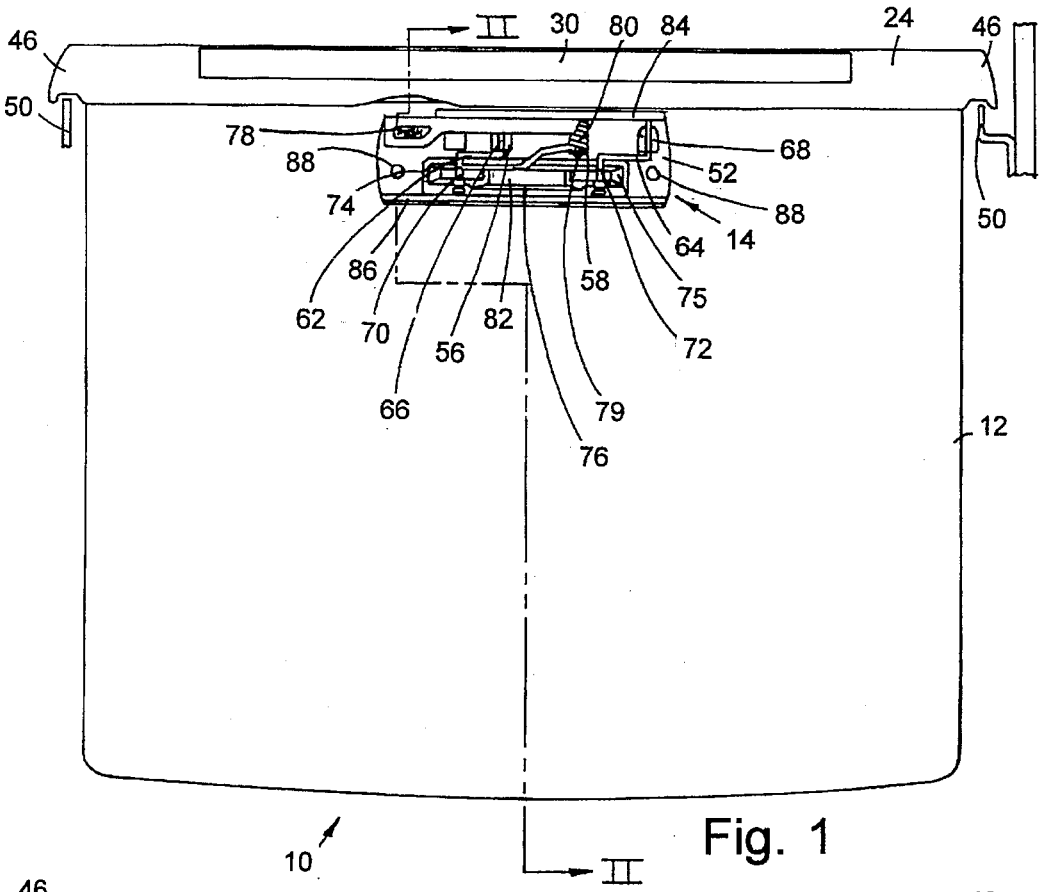
FIG. 1 is a front elevational view of the clipboard of the present invention, shown suspended on parallel rails.
Figure 5:
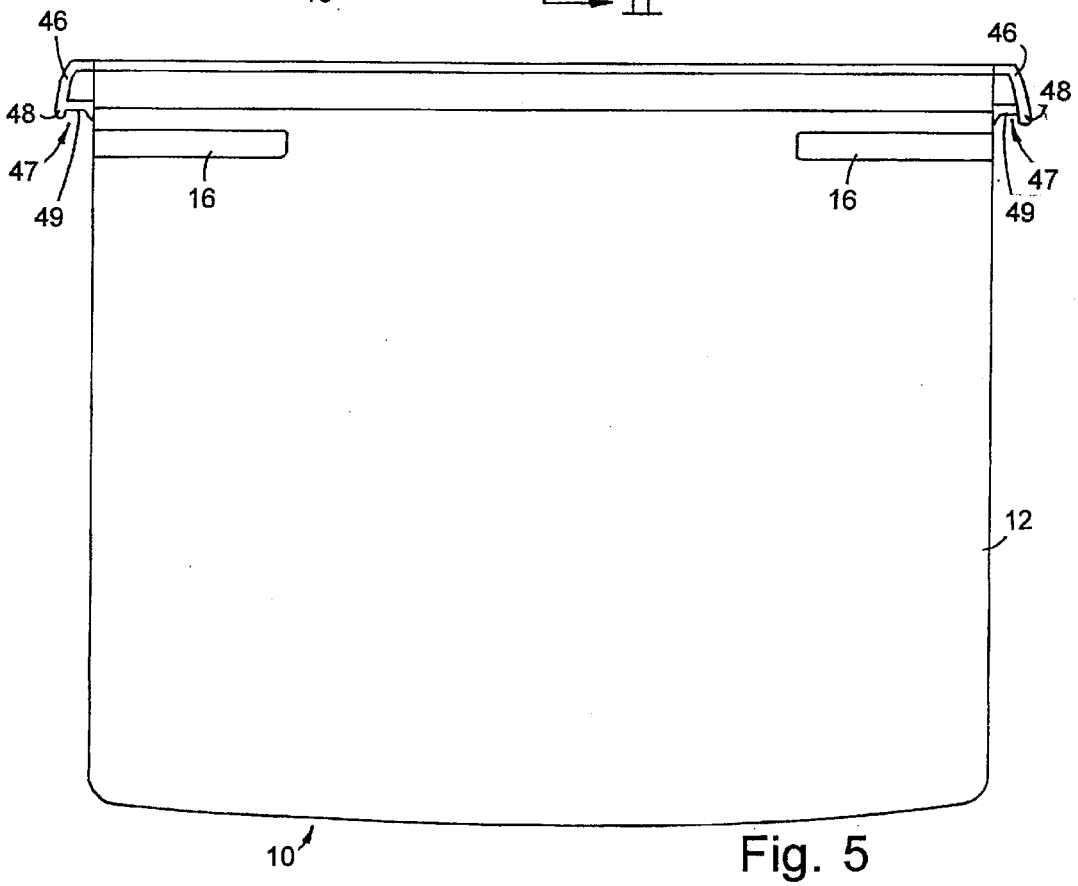
FIG. 5 is a back elevational view of the clipboard shown in FIG. 1.
Figure 2:
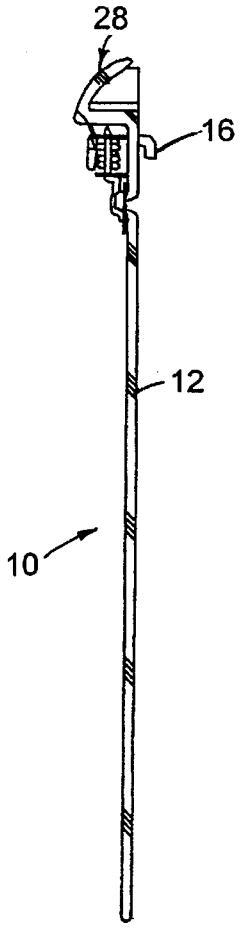
FIG. 2 is a vertical, cross section, as viewed along lines II—II of FIG. 1.
Figure 4:
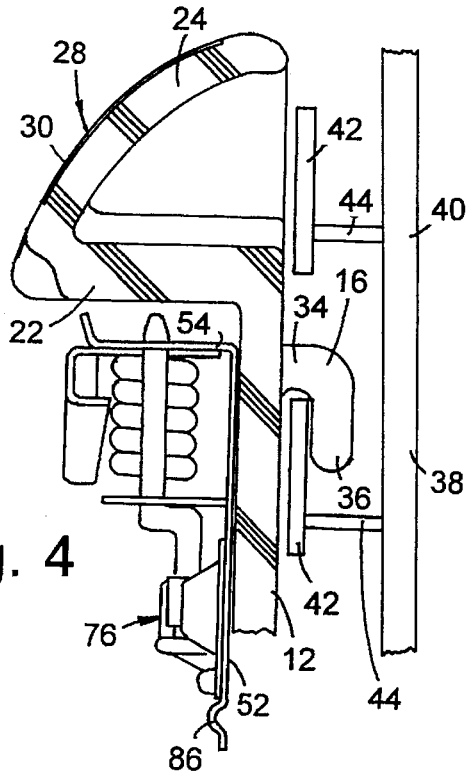
FIG. 4 is an enlarged, fragmentary, side elevational, cross section, as viewed along lines II—II of FIG. 1, which shows various details of the spring clip and upper end of the clipboard, shown suspended on a slat wall.
Figure 3:
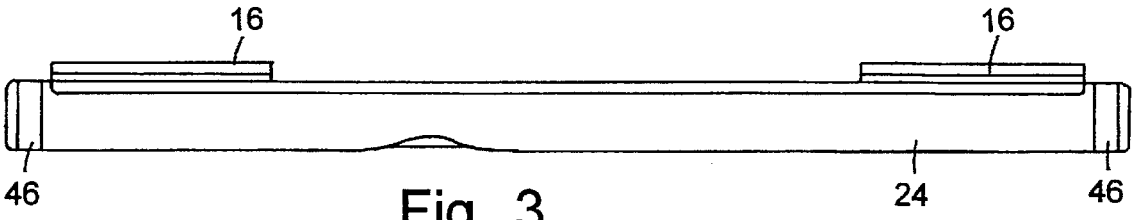
FIG. 3 is a top plan view of the clipboard shown in FIG. 1.

For purposes of description herein, ther terms "upper," "lower," "right," "left," "rear," "front," "vertical," "horizontal," and derivatives thereof shall relate to the invention as oriented in FIGS. 1 and 4. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIGS. 1–6, there is shown a clipboard 10 which includes a writing board 12, a spring clip assembly 14, a wall support 16 attached to the backside of the writing board for hanging the clipboard on a slat wall 38 and a pair of tabs 46. Each of the tabs 46 extends laterally outwardly of one of the side edges of the writing board and has along its lower edge a recess 47 which is adapted for use in suspending the clipboard 10 on a pair of spaced, parallel rails 50 (FIG. 1), such as are used in conventional file drawers for supporting hanging file folders.

The writing board 12 (FIG. 1) is a generally planar sheet of material having suitable rigidity and hardness for use as a writing surface. Specifically, the material used to make the writing board 12 should be sufficiently rigid and hard so that it will not undergo any significant bending or deformation when it is used by a person holding the clipboard with one hand and writing on papers or the like retained on the clipboard with the other hand. The writing board 12 should also exhibit suitable toughness and durability to withstand being inadvertently dropped on its edge by a person using the clipboard and provide a long service life. Suitable materials include any of various materials known to be useful or which would obviously be useful in making a writing board, including thermoplastic and thermoset polymers, metals such as aluminum, wood, etc., as well as various composite and/or laminated materials. However, for achieving an excellent balance of good physical properties, low fabrication costs and an appealing appearance, thermoplastic materials, particularly ABS, are presently preferred.

The clipboard 10 desirably includes a clip guard 22 (FIG. 4) and label support 24 at the top end of the writing board 12. The clip guard 22 extends outwardly generally normal to the writing board 12. An upwardly extending portion 24 curves upwardly away from the outward edge of the clip guard 22 and back toward the plane of the writing board. Clip guard 22 should extend outwardly at least to the upper portions of the spring clip assembly 14 to guard against papers, file folders or other material getting snagged or caught by the components of the spring clip assembly, such as when the clipboard 10 is stored along with other similar clipboards or with hanging files on spaced, parallel rails of a file cabinet. The upwardly extending label support 24 provides a surface 28 which is readily viewable when the clipboard 10 is hung on a slat wall or when the clipboard 10 is suspended on spaced, parallel rails of an open file drawer. While the label support 24 preferably curves upwardly and backwardly to present a convex surface 28 which is easily viewable from either above or in front of the clipboard, it should be understood that acceptable viewing of a label on the label support 24 can be achieved whether portion 26 is flat, concave, convex or some combination thereof. Accordingly, the exact shape of the label support 24 is not critical, although it is highly desirable that the upper portion of the surface 28 be positioned backward from the lower portion thereof so that a label on the surface 28 can be viewed from either above or in front of the clipboard 10 when it is in an upright position, such as in a file storage unit having spaced, parallel file support rails 29 (as shown in FIG. 1) or when the clipboard is supported on a slat wall (as shown in FIG. 4). Likewise, various alternative structures can be used to provide a clip guard 22 which generally overlies the upper side of the clip 14 to prevent snagging of materials by the clip. For example, a suitable clip guard 22 could be formed with a label surface by extending the writing board 12 upwardly past the spring clip assembly 14 and then downwardly and forwardly toward and preferably at least slightly past the upper, front edge of the clip 14.

The clipboard preferably includes a recessed label area 30 (FIG. 4) which is desirably located on surface 28 to permit viewing of a label from in front of or above the clipboard 12. The recess 26 is adapted to receive one or more adhesive labels (not shown). As an alternative, the label surface 28 can be provided with a textured area 30 on which dry markers can be used to apply indicia that can later be erased.

The illustrated clipboard has two wall supports 16 (FIGS. 2–4), each comprising a rib portion 34 which extends generally normally from the back side of the writing board 12 and an integral depending flange portion 36 extending downwardly from the outward end of the rib portion 34, and provide a hook for hanging the clipboard on the slat wall 38, as shown in FIG. 4. Slat walls are well known and commonly used in retail establishments to display merchandise and in offices to hang various shelves, bins, racks and the like. Slat walls generally comprise a supporting backwall 40 (FIG. 4) and one or more elongate slats 42 which are arranged horizontally with the plane of the slat being parallel with the backwall. Each of the slats is cantilevered from the backwall 40 by an integral rib member 44 which is generally normal to both the backwall 40 and slat 42 and which extends therebetween.

The tabs 46 (FIG. 5) project laterally outwardly of the side edges of the writing board 12 from the two top corners of the clipboard 10. Each of the outwardly projecting tabs 46 has along its lower edge a downward projection 48 and an adjacent shoulder 49 which are adapted to engage the upper edges of narrow rails 50 (FIG. 1) of an associated file drawer or other suspended-file storage unit. The tabs 46, support members 32, clip guard 22 and label support 24 are preferably integrally formed as by injection molding of a thermoplastic polymer material.

The spring clip assembly 14 (FIG. 1) can be generally any spring clip which is known to be useful for holding papers or the like onto a clipboard. The illustrated spring clip includes a base 52 which is mounted to the writing board 12 and has an integral upper flange 54 and integral stub flanges 56, 58 and 60 which are spaced downward of and parallel with the upper flange 54. Linkage 62 is pivotally retained within openings of flanges 54 and 56 which are axially aligned with the lower arm 66 of linkage 62. Likewise, linkage 64 is pivotally retained within openings of flanges 54 and 60 which are axially aligned with the lower arm 68 of linkage 64. The upper arm portions 70 and 72 of linkages 62 and 64 are pivotally retained within embossed portions 74 and 75 of a paper retainer bar 76. A lever 78 is pivotally mounted at one end on a pin 79 held within opposing openings of flanges 54 and 58. A coil spring 80 has arms projecting from each end, including a first arm which is pivotally secured within an opening on an embossed area 82 of the paper retainer bar 76 and a second arm (not shown) which extends in a direction parallel with the longitudinal direction of the lever 78 and is secured thereto. The lever 78 includes an upwardly projecting catch (not shown) which engages an opening (not shown) in the flange 54 to lock the paper retainer bar 76 down onto the clipboard to hold paper position between the base 52 and the paper retainer bar. The base 52 of the spring clip assembly 12 also has an upper lip 84 to guide fingers away from the edge of flange 54 and away from the upwardly protruding ends of linkages 62, 64 and pin 79. An embossed ridge 86 along the bottom edge of base 52 provides an improved grip on any paper or the like being held by the clip 14. The clip 14, shown in the drawings and described above, is commercially available and widely used with conventional clipboards and paper binders. Accordingly, further details regarding the structure and fabrication of the clip 14 are well known and need not be described herein.

The clip 14 is opened or loosened by pushing on the end of lever 78 toward the base 52 and slightly toward the lower edge of the base. As an additional preferred option, a small cutout area can be provided in the clip guard 22 adjacent the end of lever 78 to help guide a person's thumb or finger to the end of lever 78 when the clip is being opened (or loosened).

The clip 12 can be made intergral with or secured by any of various known fastening means, but is most preferably secured to the writing board 12 by integrally forming, on the front of a thermoplastic board 12, a pair of cylindrical stubs which are adapted to pass through openings 88 of the clip assembly 14. The thermoplastic stubs are subsequently heated sufficiently to cause them to flow and reshaped to form rivet-like heads which extend beyond the outer edges of the opening 88. The reshaped stubs are allowed to cool, thereby forming a rivet-like fastener which secures the clip 14 to the board 12.

In view of the above description, those of ordinary skill in the art may envision various modifications which would not depart from the inventive concepts disclosed herein. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. A clipboard comprising a writing board, a spring clip disposed on a front side of said writing board for holding papers on said writing board, and a hook disposed on a backside of said writing board for suspending said clipboard on a slat wall, said hook including a rib portion which extends from the backside of the writing board and a flange portion depending from said rib portion, and a pair of tabs which project laterally outwardly from opposing side edges of said writing board, each of said tabs including along lower edges thereof a hanger for engaging the upper edges of spaced, parallel rails of a suspended-file storage unit.

2. The clipboard of claim 1, wherein said hanger includes a downward projection and an adjacent shoulder.

3. The clipboard of claim 2, further comprising a clip guard disposed along the upper end of said writing board, said clip guard generally overlying an upper portion of the spring clip to guard against material getting snagged by the components of said spring clip.

4. The clipboard of claim 3, further comprising a label support at an upper end of the clipboard, said label support having a surface for a label which can be viewed from above and in front of the clipboard.

5. The clipboard of claim 4, wherein said tabs, said wall support, said clip guard and said label support are integrally formed of a thermoplastic polymer material.

6. The clipboard of claim 4, wherein said clip guard includes a small cutout area adjacent to an end of a lever of the spring clip, said cutout area being adapted to guide a thumb or finger to said end of said lever.

7. A clipboard comprising a writing board, a spring clip disposed adjacent an upper end on a front side of said writing board to hold papers on said writing board, and a pair of tabs, each of said tabs projecting laterally outward from opposing side edges of said writing board, and each of said tabs including along lower edges thereof a hanger for engaging the upper edges of spaced, parallel rails of a suspended-file storage unit, said hanger including a downward projection and an adjacent shoulder.

8. The clipboard of claim 7, further comprising a clip guard disposed along the upper end of said writing board, said clip guard generally overlying an upper portion of the spring clip to guard against material getting snagged by the components of said spring clip.

9. The clipboard of claim 8, further comprising a label support at an upper end of the clipboard, said label support having a surface for a label which can be viewed from above and in front of the clipboard.

10. The clipboard of claim 9, wherein said tabs, said clip guard and said label support are integrally formed of a thermoplastic polymer material.

11. The clipboard of claim 10, wherein said clip guard includes a small cutout area adjacent to an end of a lever of the spring clip, said cutout area being adapted to guide a thumb or finger to said end of said lever.

12. A clipboard comprising a spring clip disposed on a front side of a writing board, a wall support disposed on a backside of said writing board for suspending said clipboard on a slat wall, and a pair of tabs, each of said tabs projecting laterally outward from opposing side edges of said writing board, and each of said tabs including, along lower edges thereof, a hanger for engaging the upper edges of spaced, parallel rails of a suspended-file storage unit.

13. The clipboard of claim 12, wherein said wall support is comprised of a rib portion which extends generally normal from the backside of the writing board and a flange depending from an outward end of said rib portion.

14. The clipboard of claim 13, wherein said hanger includes a downward projection and an adjacent shoulder.

15. The clipboard of claim 14, further comprising a clip guard disposed along the upper end of said writing board, said clip guard generally overlying an upper portion of the spring clip to guard against material getting snagged by the components of said spring clip and a label support at an upper end of the clipboard, said label support having a surface for a label which can be viewed from above and in front of the clipboard.

16. The clipboard of claim 15, wherein said tabs, said wall support, said clip guard and said label support are integrally formed of a thermoplastic polymer material.

17. The clipboard of claim 16, wherein said clip guard includes a small cutout area adjacent to an end of a lever of the spring clip, said cutout area being adapted to guide a thumb or finger to said end of said lever.

18. A clipboard comprising a writing board, a spring clip disposed on a front side of said writing board for holding papers on said writing board, a hook disposed on a backside of said writing board for suspending said clipboard on a slat wall, and a pair of tabs which project laterally outwardly from opposing side edges of said writing board, each of said tabs including along lower edges thereof a hanger for engaging the upper edges of spaced, parallel rails of a suspended-file storage unit.

* * * * *